United States Patent [19]

Munroe

[11] 4,037,786

[45] July 26, 1977

[54] ENERGY RECOVERY AND STORAGE SYSTEM

[75] Inventor: Patrick Oliver Munroe, Tulsa, Okla.

[73] Assignee: International Telephone and Telegraph Corporation, New York, N.Y.

[21] Appl. No.: 605,051

[22] Filed: Aug. 15, 1975

[51] Int. Cl.[2] ..... F24D 3/08; F24H 1/22

[52] U.S. Cl. ..... 237/19; 236/91 A; 165/105; 165/DIG. 2; 126/101

[58] Field of Search ..... 165/DIG. 2, 105; 236/91 A; 237/19, 55, 1 A; 122/20 B, 33; 126/101, 271

[56] References Cited

U.S. PATENT DOCUMENTS

| | | | |
|---|---|---|---|
| 2,362,940 | 11/1944 | Skerritt | 165/39 |
| 3,299,881 | 1/1967 | Koch | 126/271 |
| 3,303,361 | 2/1967 | Mantini | 165/105 |
| 3,688,838 | 9/1972 | Sturm et al. | 165/105 |
| 3,779,310 | 12/1973 | Russell | 165/105 |
| 3,875,926 | 4/1975 | Frank | 165/105 |
| 3,880,230 | 4/1975 | Pessolano et al. | 237/19 |
| 3,884,292 | 5/1975 | Pessolano et al. | 165/105 |
| 3,896,992 | 7/1975 | Borovina et al. | 165/DIG. 2 |
| 3,916,991 | 11/1975 | Trump | 165/DIG. 2 |
| 3,944,136 | 3/1976 | Huie | 165/DIG. 2 |

*Primary Examiner*—William F. O'Dea
*Assistant Examiner*—Henry C. Yuen
*Attorney, Agent, or Firm*—James B. Raden; William J. Michals

[57] ABSTRACT

Heat pipes are employed to capture energy normally lost in the form of heat in the gases in flue-stacks and to transfer the captured heat to water in a water jacket. The heated water is pumped from the water jacket to a storage tank where it is kept until needed. Control of the system is governed by heat sensors in the flue-stack and in the storage tank which provide control signals to a pump, or pumps, used in controlling the flow of water through the pipes between the water jacket and the storage tank.

9 Claims, 3 Drawing Figures

ENERGY RECOVERY AND STORAGE SYSTEM

BACKGROUND OF THE INVENTION

1. Field of the Invention

A system is disclosed for use with water circulating devices to enable recovery of heat from flue gases and the like. The system employs means for transferring heat from the flue gases to water and then circulating the heated water to storage means, such as a water tank, for subsequent use. Sensing means are included for use in the flue-stack and in the water tank to provide signals, when temperatures are suitable in the flue-stack and the tank, which control pump means to divert the flow of heated water to the storage tank and cold water from the storage tank.

2. Description of the Prior Art

The prior art systems for transferring heat from one medium to another include heat exchangers making use of a number of pipes in a shell. Such heat exchangers are too cumbersome and too expensive for use in many systems for which the present invention, employing heat pipes, is suited. Other systems are know in the prior art which make use of heat pipes. These generally have been limited to the transfer of heat from a hot gas source to a cooler gas. These latter systems have the characteristic disadvantage that the heat must immediately be utilized, since there is no way available to economically store the heat in the gas for use at a later time. The transfer of heat from gases to water via heat pipes also is known from the literature. However, none of the known systems have employed circulating means controlled in accordance with measurements of temperature of the flue gases and the temperature of water in a storage tank. Furthermore, none of the known systems have suggested combining the sensing and circulating means with the storage of heat. Consequently, these earlier systems have not been useful except where the heat representing salvaged energy can be immediately used.

SUMMARY OF THE INVENTION

Objects of the present invention include the recovery of energy in the form of heat which normally is lost in flue-stacks and the storage of the recovered energy for use at a later time.

To accomplish the foregoing the ancillary objects, embodiments of the present invention employ heat pipes which are positioned to have first ends in a flue-stack while the other ends terminate in a water jacket. With this arrangement, heat from the flue gases is transferred by the heat pipes to water in the water jacket. Heated water from the water jacket is piped to a storage tank where it is kept until needed. To make the hot water flow through the pipes to the tank and to bring colder water to the water jacket, a pump is provided. The pump is turned "on" or "off" in accordance with signals received from sensors in the flue-stack and the hot water storage tank.

BRIEF DESCRIPTION OF THE DRAWINGS

The above mentioned and other features and objects of this invention and the manner of obtaining them will become more apparent, and the invention itself will be best understood by reference to the following description of an embodiment of the invention taken in conjunction with the accompanying drawings, in which.

DESCRIPTION OF PREFERRED EMBODIMENTS

Figure 1:
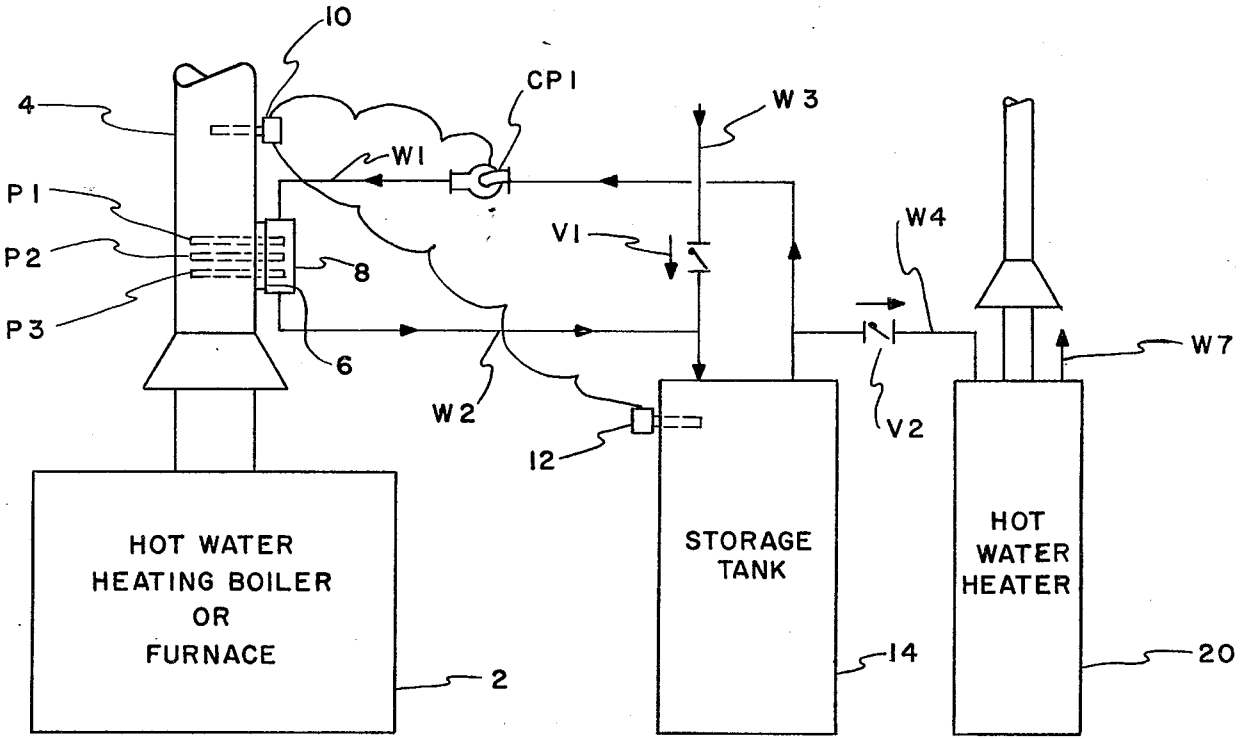
FIG. 1 is a schematic drawing showing an application of the present invention to a hot water heating system.

Turn now to FIG. 1 for a description of a preferred embodiment of the invention. In this Figure, a hot water boiler, a hot air furnace, or the like, is indicated at 2. This boiler or furnace may be fired by oil, coal, gas, or other fuels. Exhaust gases are diverted up the flue-stack indicated at 4.

Heat pipes, including three pipes indicated at P1, P2 and P3, are arranged in the flue-stack to absorb heat from the gases therein. Heat gathered by the pipes will be transmitted through the pipes in a well known manner, as explained further in connection with FIG. 3. A flue gas/water barrier at 6 separates the gases in the flue-stack 4 from water in the water jacket indicated at 8. Heat in the pipes P1, P2, P3 is absorbed by water circulating through the water jacket 8 between water pipes W1 and W2.

Circulation of water through the pipes W1 and W2 and the water jacket 8 is forced by a circulation pump CP1. The circulation pump preferably will be of small capacity, on the order of 1–3 gmp, in order to conserve power and minimize costs. Operation of the pump CP1 is determined by the condition of two controllers— a stack switch at 10 and an aquastat at 12, each of which may be a bistable switch. Each of these units may be selected from among commercially available units including units manufactured by such companies as Honeywell and White-Rodgers.

The stack switch is set to provide an "on" signal to energize the Pump CP1 when the temperature of gases in the flue-stack rises above a first selected level. When the temperature drops below a second selected level, the stack switch removes the "on" signal to turn the pump "off". In this way, the stack switch 10 activates the pump to cause circulation when heat is available in the flue-stack which can be used in heating water and also turns the pump "off" to prevent excessive cooling in the flue-stack when the flue gases are cold and the water in the pipes W1 and W2 is even colder. It will be understood that such excessive cooling is undesirable in flue-stacks because it promotes condensation in the flue which causes damage to the flue from corrosion, deposition of undesirable materials and the like.

A second controller for the circulating pump CP1 is represented by an aquastat 12 in the storage tank. The aquastat senses the temperature of water in the storage tank 14 and provides signals accordingly to the stack switch 10. If the water is cold, the aquastat will signal that the circulating pump should be on. If the heat sensing mechanism in the stack switch determines that the flue gas is hot enough, then it will respond favorably to an "on" signal from 12 and transmit an "on" signal to the pump. However, if the temperature of the gases in the flue-stack is too low to effectively heat the water in the storage tank, a signal to turn the pump on will not be transmitted from the stack switch, since the cold water might chill the stack causing condensation therein and possible damage to the stack.

In the arrangement shown in FIG. 1, it will be seen that cold water from a source not shown will be supplied through the water pipe W3, past a check valve V1 to the storage tank. This cold water will be supplied when necessary to replace water withdrawn through the pipe W4 and check valve V2.

Heated water drawn into the hot water tank 20 from the storage tank 14 will not need to be heated as much as would cold water delivered directly from the cold water supply. It will be seen, therefore, that substantial savings in the costs of heating water may be effected by using a system according to the invention during the heating season.

Figure 2:
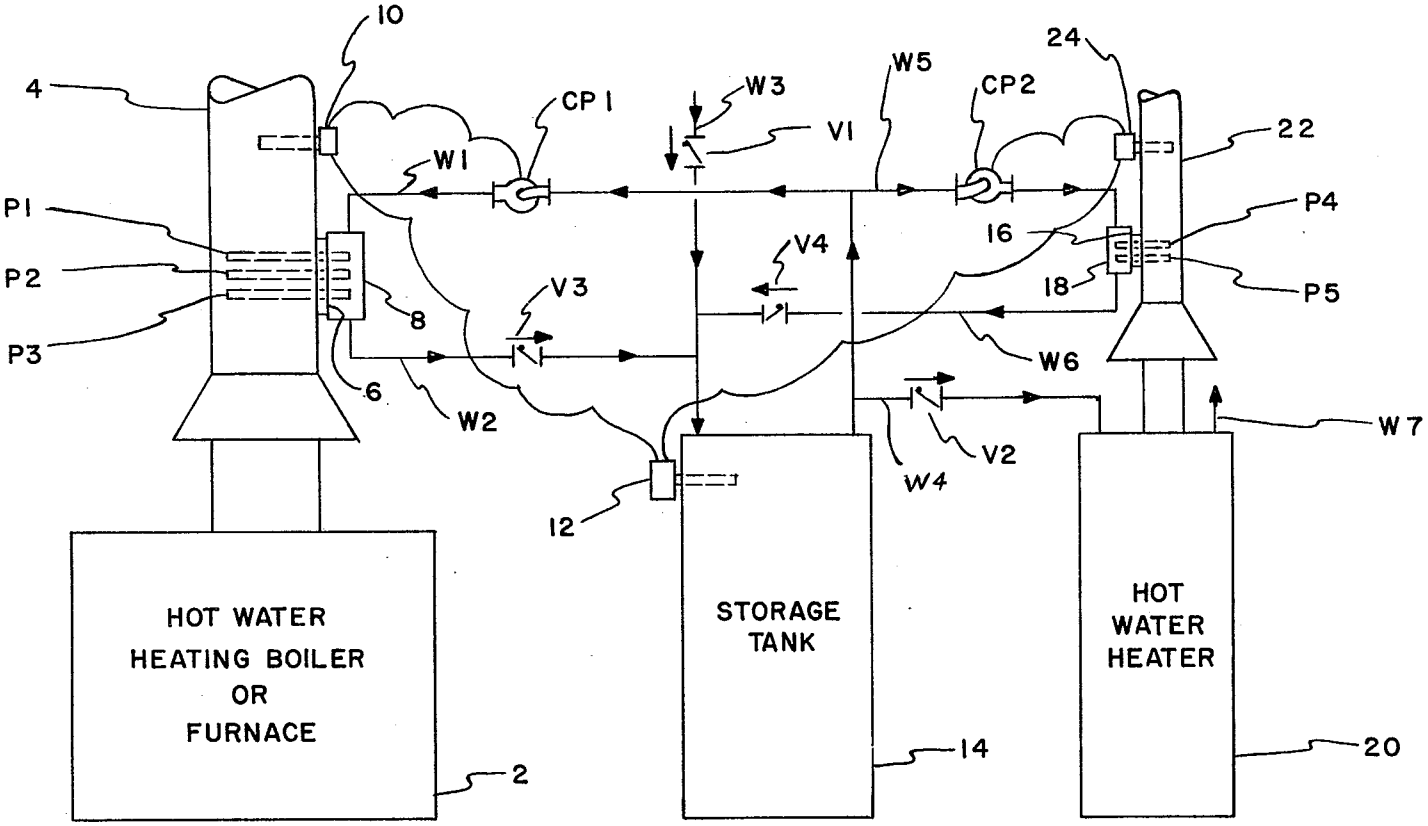
FIG. 2 depicts an additional adaptation of the invention to a heating system.

FIG. 2 illustrates a more extensive system which includes the apparatus of FIG. 1 to heat water from waste energy in he flue-stack 4 of a heating plant and to store the heated water in a storage tank 14 from which the heated water can be transferred into a hot water heater. The embodiment of FIG. 2, besides showing means for conserving energy from the flue-stack 4 of a heating plant, shows a system for extracting energy from the flue-stack 22 of a hot water heater. To this end, heat pipes shown at P4 and P5 are arrayed in the flue-stack of a hot water heater to transfer heat from the flue-stack through the flue gas/water barrier 16 to water in a water jacket 18. The water in 18 is fed from water pipe W5, and is fed to the water pipe W6. A circulating pump at CP2 under control of the aquastat 12 and the stack switch 24 will force water through the pipes W5 and W6 at a low speed. Check valves at V3 and V4 prevent cold water from flowing from pipe W3 into pipes W2 and W6, respectively. As in FIG. 1, cold water will be supplied to the storage tank 14 as hot water is extracted from the storage tank 14 and transferred through the pipe W4 to the hot water tank 20. Hot water may be extracted through pipe W7 for use when needed.

Figure 3:
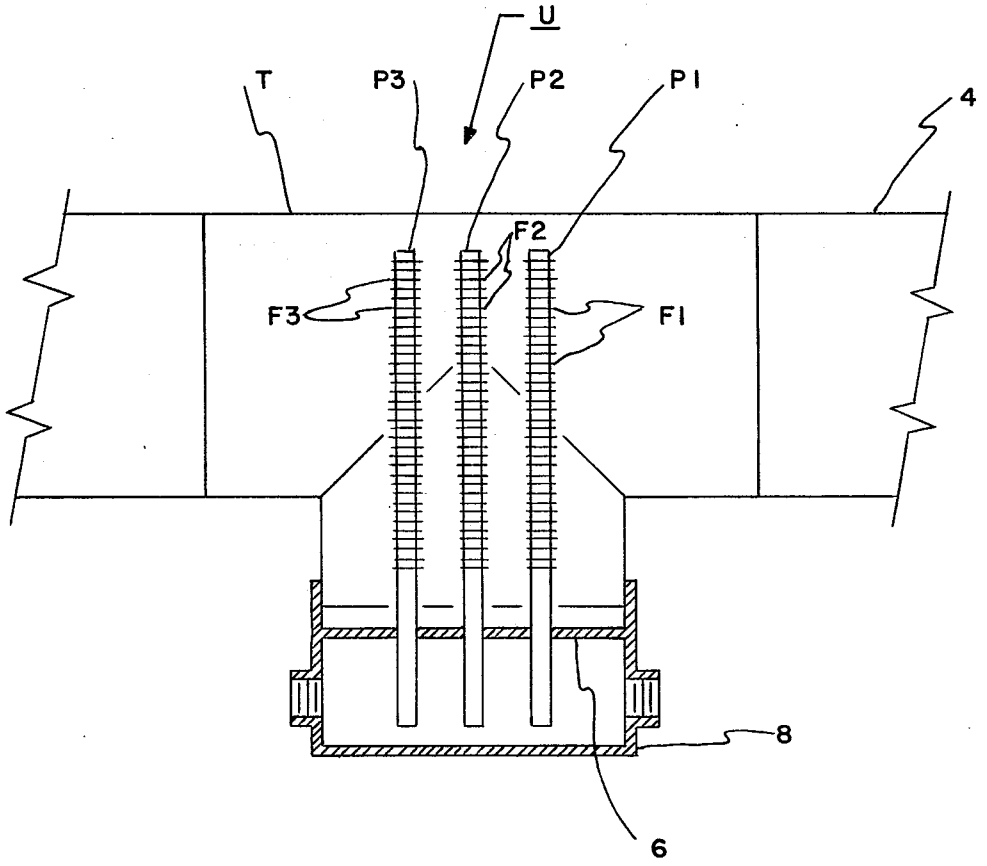
FIG. 3 is a representation of a heat pipe recovery unit of use in the practice of the invention.

An arrangement of heat pipes as a heat pipe recovery unit U for use in flue pipes is shown in partial section in FIG. 3. In this figure, the same identifying numbers are used for parts corresponding to those shown in FIGS. 1 and 2.

A standard flue pipe tee-section T may be combined with a water jacket 8 and heat pipes at P1, P2 and P3 extended through a water barrier 6 to form the heat pipe recovery unit U. Heat pipe recovery units of suitable sizes and employing many heat pipes may then be inserted as units into standard flue-stacks to enable recovery of heat from the flue-stacks.

The heat pipes P1, P2 and P3 are standard items which may be equipped with fins F1, F2, F3 to better receive heat from the gas and are capable of transferring heat energy from either end to the other. They consist of sealed pipes enclosing a fluid in a state of equilibrium between the gaseous and the liquid states. Heat applied to the pipe (generally at the finned end) will raise the temperature in the adjacent part of the pipe causing additional gas to form within the heat pipe which causes very rapid transmission of heat through the pipe to remote parts of the pipe (generally the other end of the pipe), where condensation will occur with attendant release of heat in those remote parts of the pipe. A wick formed adjacent to the wall of the pipe provides a carrier, through capillary action, for the return of liquid to its source in the pipe.

It will be recognized, of course, that heat flow through the heat pipes P1, P2, P3 can take place in either direction. In FIG. 3, for example, heat may flow away from the water jacket 8 and toward the flue-stack 4 when the water in the water jacket is warmer than the gases in the flue-stack. This situation can lead to undesirable results in the context of the present invention, since the water in W1, W2 and 8 would be chilled instead of heated. This would be undesirable in a heating system— causing it to operate instead as a cooling system. Accordingly, under these conditions, the aquastat 12 and stack switch 10 are arranged to stop the pump CP1 and stop the flow of water in W1, W2 and 8, thus preventing the chilling of the water.

While the principles of the invention have been described above in connection with specific apparatus and applications, it is to be understood that this description is made only by way of example and not as a limitation on the scope of the invention.

I claim:

1. An energy conservation and storage system comprising a heat pipe and fluid circulating means including fluid pipes interconnecting a fluid jacket and a fluid storage tank, means positioning the heat pipe to enable one end to extend into a space through which energy in the form of heat is available and the other end to extend outside the said space in contact with fluid in the fluid jacket, circulating means for circulating fluid through said fluid jacket and said fluid pipes, said circulating fluid transferring heat from the fluid jacket to the storage tank, first temperature sensitive control means positioned in said space and responsive to a first signal and to a range of temperature in said space to control said circulating means and thereby regulate the circulation of fluid through said fluid jacket and the transfer of heat to the storage tank and second temperature sensitive control means coupled to said storage tank responsive to a range of temperatures in said tank to provide said first signal, thereby to place a demand that said circulating means supply hot fluid to said tank.

2. The invention as claimed in claim 1, in which the circulating means includes a pump, said pump enabling the transfer of hot fluid from said fluid jacket to said storage tank and the transmission of cold fluid from the storage tank to said fluid jacket.

3. An energy conservation and storage system comprising a heat pipe, hot water circulating means, said hot water circulating means including water pipes interconnecting a water jacket and a storage tank, means positioning the heat pipe to enable one end to extend into a flue-stack and the other end to extend outside the flue-stack, the one end of the heat pipe contacting flue gases and the other end contacting water in the water jacket, said heat pipe enabling the transfer of heat from gases in the flue-stack to water in the water jacket, circulating means for circulating water through said water jacket and said water pipes, said circulating water enabling the transfer of heat from the end of the heat pipe in the water jacket to the storage tank, first temperature sensitive control means positioned in said flue-stack responsive to a first signal and to a range of temperatures in said flue-stack to provide control signals to said circulating means and thereby regulate the circulation of water through said water jacket and the transfer of heat to the storage tank; wherein the circulating means includes a pump, said pump enabling the transfer of hot water from said water jacket to said storage tank and the transmission of cold water from the storage tank and the transmission of cold water from the storage tank to said water jacket, and second temperature sensitive control means coupled to said storage tank and responsive to a range of temperatures in said tank to provide said first signal thereby to place a demand that said pump supply hot water to said tank.

4. An energy conservation and storage system comprising a heat pipe and hot water circulating means including water pipes interconnecting a water jacket and a storage tank, means positioning the heat pipe to enable one end to extend into a flue-stack in contact with flue gases and the other end to extend outside th flue-stack in contact with water in the water jacket, said heat pipe transferring heat in the flue-stack to water in the water jacket, circulating means for circulating water through said water jacket and said water pipes, said circulating water transferring heat from the water jacket to the storage tank, first temperature sensitive control means positioned in said flue stack responsive to a first control signal and to a range of temperatures in said flue-stack to control said circulating means and thereby regulate the circulation of water through said water jacket and the transfer of heat to the storage tank; and second temperature sensitive control means coupled to said storage tank and responsive to a range of temperatures to provide said first control signal thereby to place a demand signal that said circulating means supply hot fluid to said storage tank.

5. An energy conservation and storage system comprising heat transfer means capable of receiving energy in the form of heat and transferring the heat to a fluid for storage in storage means, means for positioning said heat transfer means to enable a first portion to extend into a flue-stack for contact with flue gases and a second portion to extend outside the flue-stack for contact with fluid in a fluid holding jacket, circulating means for circulating fluid through said fluid holding jacket to remove heat supplied by the heat transfer means and to transfer the fluid to the storage means, a first temperature sensitive control means positioned in said flue-stack and responsive to a first control signal and to a range of temperatures in said flue-stack to control said circulating means and thereby control circulation of fluid through said fluid holding jacket and second temperature sensitive control means coupled to said storage means and responsive to the temperature of the fluid therein to provide said first control signal when the temperature of the fluid in said storage means is less than a predetermined value, thereby to activate said circulating means.

6. The invention as claimed in claim 5, in which the heat transfer means includes a heat pipe selected to operate over the temperature ranges of gases in a flue-stack and fluid in a selected circulating means.

7. The invention as claimed in claim 6 in which the circulating means includes a plurality of pipes and a circulating pump.

8. The invention as claimed in claim 7, in which the storage means includes a tank.

9. The invention as claimed in claim 5, in which the heat transfer means includes a heat pipe selected to operate over a temperature range determined by the temperature of gases in a flue-stack and the temperature of fluids in the fluid holding jacket.

* * * * *

UNITED STATES PATENT OFFICE

CERTIFICATE OF CORRECTION

Patent No. 4,037,786 Dated July 26, 1977

Inventor(s) Patrick Oliver Munroe

It is certified that error appears in the above-identified patent and that said Letters Patent are hereby corrected as shown below:

Column 4, line 64 delete "the transmission of cold water from the storage tank and".

Signed and Sealed this

First Day of November 1977

[SEAL]

*Attest:*

RUTH C. MASON
*Attesting Officer*

LUTRELLE F. PARKER
*Acting Commissioner of Patents and Trademarks*